United States Patent [19]

Lebold

[11] Patent Number: 4,702,215

[45] Date of Patent: Oct. 27, 1987

[54] FUEL INLET ASSEMBLY FOR A CARBURETOR

[75] Inventor: John R. Lebold, Yellow Springs, Ohio

[73] Assignee: Vernay Laboratories, Inc., Yellow Springs, Ohio

[21] Appl. No.: 16,465

[22] Filed: Feb. 18, 1987

Related U.S. Application Data

[63] Continuation of Ser. No. 706,585, Feb. 28, 1985, abandoned.

[51] Int. Cl.[4] ..... F02M 5/12

[52] U.S. Cl. ..... 123/514; 261/36.1

[58] Field of Search ..... 123/510, 511, 512, 513, 123/514; 261/36 A, 66, 70, 36.1

[56] References Cited

U.S. PATENT DOCUMENTS

| | | | |
|---|---|---|---|
| 3,674,043 | 7/1972 | Norton | 123/510 |
| 4,044,746 | 8/1977 | Kaye | 123/514 |
| 4,173,958 | 11/1979 | Kato et al. | 123/514 |
| 4,195,608 | 4/1980 | Sanada et al. | 123/514 |

OTHER PUBLICATIONS

"GM Cutout? Here's Help from NAPA Echlin . . . ", NAPA News, 1981 Winter Edition.

*Primary Examiner*—Willis R. Wolfe, Jr.
*Attorney, Agent, or Firm*—Biebel, French & Nauman

[57] ABSTRACT

A carburetor for a motor vehicle includes a float chamber, a float assembly, a fuel inlet fitting for directing fuel flow along a fuel path, a needle valve for cooperating with the float assembly, and a needle valve seat within the fitting for containing the needle valve. To solve an intermittent problem with the needle valve sticking in its seat, whereby the vehicle engine cannot be started, a check valve member is disposed within the fuel path upstream from the needle valve. The valve member is of the duckbill type, and is disposed with the closed, duckbill end directed toward the needle valve. Connection of a fuel line fitting to the fuel inlet fitting clamps the valve member in place.

7 Claims, 4 Drawing Figures

FUEL INLET ASSEMBLY FOR A CARBURETOR

This is a continuation of Ser. No. 706,585, filed Feb. 28, 1985, now abandoned.

BACKGROUND OF THE INVENTION

The present invention relates generally to a fuel supply system and carburetor for a motor vehicle, and more particularly, to the needle valve assembly typically used within the carburetor at the fuel inlet port.

A basic fuel supply system for a motor vehicle includes a fuel tank, and a fuel pump which carries fuel along a fuel line through the pump and directs the fuel into a carburetor. There, it is mixed with air for subsequent combustion within the engine.

One variation on this design, provided as a means of reducing emissions from the engine, includes a fuel return line extending from the fuel pump outlet back to the tank. A check valve is provided within this line near the tank to prevent unwanted flow of fuel from the tank toward the carburetor or out of the fuel tank in the event of an accident.

At the fuel inlet to the carburetor, a needle valve is disposed for cooperation with the fuel float assembly inside the carburetor. The valve is disposed within a seat and is normally pushed to an open position by the flow of fuel into the carburetor. The rear of the needle valve is in contact with a pivotally mounted float assembly, so that as the float chamber fills with fuel, the needle valve is pushed back into its seat, thereby reducing fuel flow.

A problem which has been exhibited by some vehicles having a fuel system of this type appears after the vehicle has been operated and then shut down for some period of time. After such time, the engine cannot be restarted or, if some fuel remains within the carburetor, the engine starts long enough to use this fuel and then stops. This problem is intermittent, and thus its occurrence is impossible to predict. Further, it does not seem to affect all vehicles of a similar type.

The inability to start the engine appears to be caused by the needle valve becoming firmly stuck within its seat to the extent that fuel pressure from the fuel pump is insufficient to open the valve. Occasionally, replacement of the needle valve and seat assembly seems to cure or reduce the problem. In other instances, replacement of this assembly seems to have no effect.

What is needed therefore, is a solution to the problem of sticking of the needle valve. Of course, such a solution should be effective, but moreover, should be easily carried out and involve relatively little cost in view of the potentially large number of vehicles affected.

SUMMARY OF THE INVENTION

It is believed that the problem described above is caused as a result of evaporation and drainage of fuel from the fuel line following shutdown of the engine. A portion of the fuel line is located in close proximity to the engine, which will be quite warm after having been operated. This will tend to cause fuel still within the fuel line to evaporate and expand. However, due to the internal valving within the fuel pump, the expanding fuel must move into the excess fuel return line, from which it passes into the tank. Due to the check valve provided in this line to prevent fuel from flowing out of the tank, however, fuel cannot be pulled back into the line as the engine compartment cools and the fuel within the line condenses. Thus, a partial vacuum is created within the line. This vacuum acts upon the needle valve, pulling it firmly into its seat, whereupon it oecomes lodged in place.

In solving this problem, the present invention is provided within a motor vehicle fuel system having a tank, a fuel pump, and a carburetor including a fuel inlet. A first fuel line connects the pump inlet and the tank, while a second fuel line connects the pump outlet and the carburetor fuel inlet. A third fuel line connects the pump outlet with the tank. A first check valve is disposed within the third fuel line near the tank for preventing flow from the tank into the third fuel line. The carburetor further includes a needle valve located within the fuel inlet. The improvement provided by the present invention includes a second check valve disposed within the carburetor fuel inlet for preventing flow from the vicinity of the needle valve toward the fuel pump and the tank.

More specifically, the carburetor may include a float chamber, a float assembly, and a means defining a needle valve seat within the carburetor fuel inlet for containing the needle valve. The needle valve itself then cooperates with the float assembly to regulate the flow of the fuel into the float chamber.

The check valve may be constructed as a single piece from a resilient material and includes a pair of lips arranged in a converging relationship to define for the valve an open end and a normally closed end. At the closed end, the lips are disposed adjacent each other to define a normally closed slit, and at least one side wall connects the lips. An annular flange is directed outwardly about the open end of the valve member. The valve member is disposed with its closed end directed toward the needle valve, and is clamped by its flange for retaining the valve within the fuel inlet.

Accordingly, it is an object of the present invention to provide a fuel inlet assembly for a carburetor for the engine of a motor vehicle that avoids intermittent sticking of the needle valve within its seat, thereby facilitating starting of the engine; to provide such a carburetor in which the improved inlet assembly has no effect upon the normal operation of the carburetor; to provide such a carburetor in which the improved inlet assembly can be made to an existing carburetor on a retrofit basis; and to provide such a carburetor in which the improved inlet assembly can be made with relatively little expense.

Other objects and advantages of the present invention will be apparent from the following description, the accompanying drawings, and the appended claims.

DETAILED DESCRIPTION OF THE PREFERRED EMBODIMENT

Figure 1:
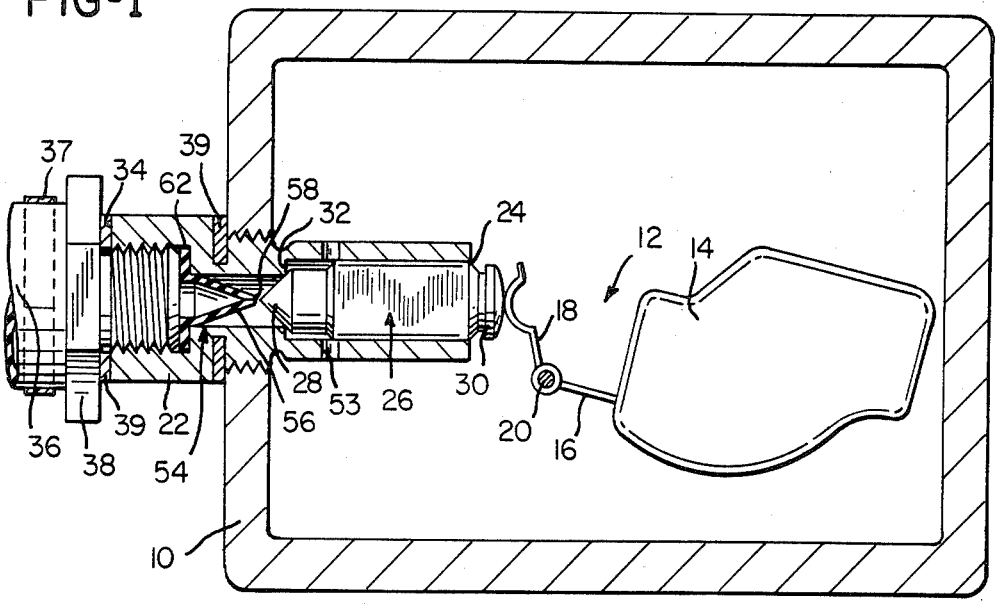
FIG. 1 is a sectional view of a portion of a carburetor, shown schematically, incorporating the improved fuel inlet assembly provided by the present invention.

Referring to FIG. 1, the float chamber 10 of a carburetor for an engine for a motor vehicle is shown schematically. Mounted within the float chamber is a float assembly 12 including at least one float 14 mounted to an arm 16 which is connected to a float assembly lever 18. Float assembly 12 is pivotally mounted to a shaft 20.

Threadingly engaged through the side wall of float chamber 10 is a fuel inlet fitting 22. Fitting 22 includes an internal open end 24 into which is placed a needle valve 26 having a forward, conical tip 28 and a rearward end 30. At the portion of fitting 22 which is disposed within the wall of chamber 10, the interior of fitting 22 narrows so to define a valve seat 32 for needle valve 26.

An outer open end 34 is provided for fitting 22, with threads extending along a portion of the interior of fitting 22. A fuel line 36 is secured by clamp 37 to a line fitting 38, which in turn is theadingly connected to outer end 34. Fuel may then be directed through line 36, through fitting 22 past needle valve 26, and into float chamber 10. Gaskets 39 may be provided to ensure a fluid-tight seal for the fuel flow path.

Figure 2:
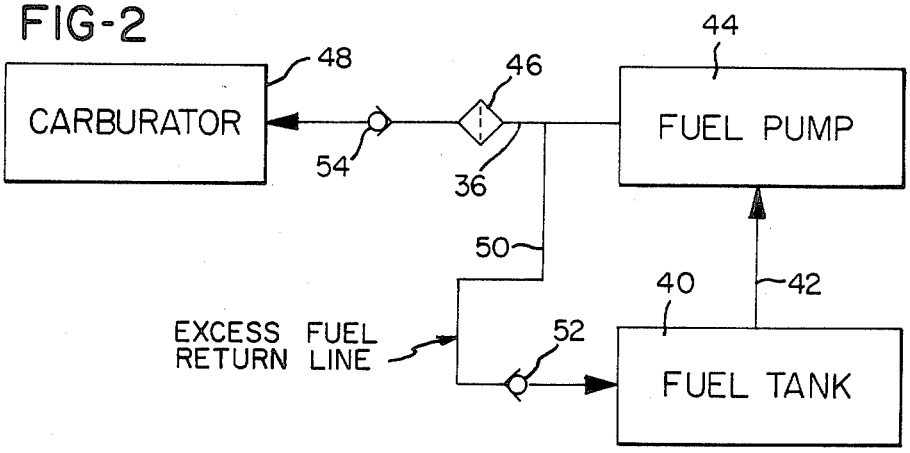
FIG. 2 is a schematic diagram of a fuel system for a motor vehicle, illustrating the operation of the present invention.

Referring now to FIG. 2, a fuel system is shown in which fuel is stored in a fuel tank 40. A fuel line 42 directs fuel from tank 40 to fuel pump 44, from which fuel is directed along line 36 to carburetor 48. A fuel filter 46 is disposed within line 36. An excess fuel return line 50 connects the pump with tank 40.

A check valve 52 is provided within return line 50 at or near its entry into tank 40. Check valve 52 is provided so that in the event of an accident in which the vehicle is overturned, fuel will not be able to flow from tank 40 through return line 50 to carburetor 48, where the fuel could spill creating the potential for fire or explosion. Since a typical fuel pump 44 will include internal valving that closes the fuel path when the pump is not operating, fuel would not flow through line 42 to line 36.

In operation, pump 44 directs fuel from tank 40 to carburetor 48. Referring to FIG. 1, the fuel pressure generated by the fuel pump moves needle valve 26 rearwardly so that fuel can enter flow chamber 10 through flow passages 53. Fuel may enter chamber 10 more rapidly than the engine can accept the fuel, so that chamber 10 may fill with fuel. Upon reaching a sufficient level within the chamber 10, the fuel will raise float 14, pivoting float assembly 12 about shaft 20, and causing lever 18 to move needle valve 26 back into its seat 32. This prevents the flow of fuel into chamber 10. Thus, referring back to FIG. 2, fuel can no longer flow through line 46, and must be directed through line 50 back to fuel tank 40.

When the vehicle engine is shut down, a certain amount of fuel will remain within each of fuel lines 42, 36 and 50. Since a portion of fuel line 36 will be in close proximity to the engine, the temperature of this line will remain fairly high. This will tend to vaporize and expand the volatile fuel within the line. The internal valving within pump 42 will prevent movement of the fuel through the pump, and thus the fuel will pass through return line 50 and back to tank 40 through check valve 52.

As the engine compartment and fuel line 36 cools, the fuel will begin to condense and contract. However, due to the presence of check valve 52, fuel cannot be drawn into lines 36 and 50 to fill the vacuum created by the condensing fuel. Thus, the vacuum created within these fuel lines acts upon needle valve 26, pulling it firmly into its seat 32. This pulling force then causes the valve to become stuck within its seat 32, thereby preventing starting of the engine at a later time, or causing fuel starving when any fuel within the float chamber is exhausted.

To solve this problem, the present invention provides a check valve 54 disposed between line fitting 38 and needle valve 26. As shown in FIG. 2, the function of check valve 54 is to prevent fuel from being drawn away from needle valve 26 and its seat 32. Accordingly, check valve 54 is positioned to permit flow towards carburetor 48, but to prevent its backward flow. Hence, despite the evacuation of fuel from line 36, the region around needle valve seat 32 retains fuel and is protected from any resulting vacuum.

Figure 4:
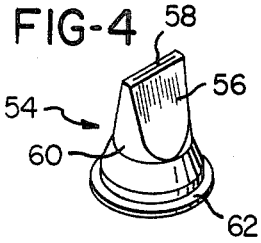
FIG. 4 is a perspective view of the check valve used within the fuel inlet assembly.

As seen more specifically by reference to FIG. 4, check valve 54 is preferably of the duckbill type, and is formed as a single piece from a resilient material. The valve 54 includes a pair of lips 56 arranged in a converging relationship to define a normally closed end for the valve 54 where lips 56 are disposed adjacent each other to define a normally closed slit 58. A cylindical side wall 60 connects the lips 56. Additionally, an annular flange 62 extends outwardly about the open end of the valve 54.

Figure 3:
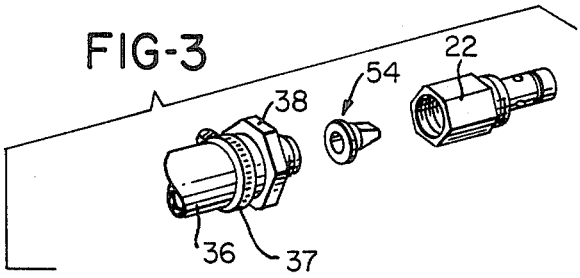
FIG. 3 is a perspective view of the needle valve and fuel filter assemblies, showing the fuel inlet assembly in exploded form.

Check valve 54 is formed of an appropriate size so as to be placeable within inlet fitting 22 as shown in FIG. 1. Cylindrical side wall 60 and lips 56 fit within the narrow portion of fitting 22, with flange 62 disposed so that valve member 54 can be secured in place by attachment of fuel line fitting 38. (See also FIG. 3.) This directs lips 56 toward needle valve 26 to provide the appropriate valving action.

It should be seen from the foregoing description that to add the improvement of the present invention to a carburetor requires only the check valve 54 which can be molded in large quantities ar very little expense. As seen from FIG. 3, installation requires only disconnection of fuel line fitting 38, insertion of check valve 54, and reconnection of fitting 38. Therefore, not only can the valve 54 be inexpensively produced, but it can also inexpensively and easily be installed. Installation can be made either at the time of manufacture of the vehicle, or can be performed on a retrofit basis.

In some vehicles, the fuel filter mounts directly into the fuel inlet fitting 22. It will, of course, be recognized that in such a case, the filter may be used to secure valve 54 into place in a manner identical to that with fuel line fitting 38.

It should be recognized that it is possible to utilize other types of check valves in place of duckbill type valve 54. However, it should be noted that other types of valves may require more complex installation procedures, or alterations to fitting 22 or other components of the carburetor or fuel system, and thus the duckbill valve shown in the drawings represents the preferred embodiment.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In a motor vehicle fuel system having a tank, a fuel pump including a pump inlet and a pump outlet, a carburetor including a fuel inlet, a first fuel line connecting said pump inlet and said tank, a second fuel line connecting said pump outlet and said carburetor fuel inlet, and a third fuel line connecting said pump outlet and said tank, a first check valve disposed within said third fuel line near said tank for preventing flow from said tank into said third fuel line, said carburetor further including a needle valve disposed within said fuel inlet, the improvement comprising:

a second check valve disposed within said carburetor fuel inlet for preventing flow from the vicinity of said needle valve toward said fuel pump and said tank;

said fuel inlet including an inlet fitting mounted within said carburetor, said inlet fitting defining a seat for said needle valve;

said fuel system including a fuel line fitting secured to said second fuel line and connected to said inlet fitting;

said second check valve being disposed within said inlet fitting and secured therein by connection to said inlet fitting of said fuel line fitting;

said second check valve including a valve member which is constructed as a single piece from a resilient material;

said valve member including a pair of lips arranged in a converging relationship to define for said valve member an open end and a normally closed end whereat said lips are disposed adjacent each other to define a normally closed slit therebetween, at least one side wall for connecting said lips, and an annular flange directed outwardly about the open end of said valve member;

said inlet fitting including an outer end portion, the interior surface of said outer end portion including means for securing said fuel line fitting thereto, a relative narrow central section, and a junction region between said outer end portion and said central section;

said valve member being disposed within said inlet fitting by placement of said lips and said side wall into said central section of said fitting with said flange positioned adjacent said junction region; and said valve member being secured by connection of said fuel line fitting to said fitting by said securing means, whereby said flange is held between said fuel line fitting and said junction region.

2. In a motor vehicle fuel system having a tank, a fuel pump including a pump inlet and a pump outlet, a carburetor including a fuel inlet, a first fuel line connecting said pump inlet and said tank, a second fuel line connecting said pump outlet and said carburetor fuel inlet, and a third fuel line connecting said pump outlet a said tank, a first check valve disposed within said third fuel line near said tank for preventing flow from said tank into said third fuel line, said carburetor further including a needle valve disposed within said fuel inlet, the improvement comprising:

a second check valve disposed within said carburetor fuel inlet for preventing flow from the vicinity of said needle valve toward said fuel pump and said tank;

said fuel inlet including an inlet fitting mounted within said carburetor, said fitting defining a seat for aaid needle valve;

said fuel system including a fuel filter disposed within said second fuel line and connected to said fitting;

said second check valve being disposed within said fitting and secured therein by connection to said fitting of said fuel filter;

said second check valve including a valve member which is constructed as a single piece from a resilient material;

said valve member including a pair of lips arranged in a converging relationship to define for said valve member am open end and a normally closed end whereat said lips are disposed adjacent each other to define a normally closed slit therebetween, at least one side wall for connecting said lips, and an annular flange directed outwardly about the open end of said valve member;

said fitting including an outer end portion, the interior surface of said outer end portion including means for securing said fuel filter thereto, a relatively narrow central section, and a junction region between said outer end portion and said central section;

said valve member being disposed within said fitting by placement of said lips and said side wall into said central section of said fitting with said flange positioned adjacent said junction region; and said valve member being secured by connection of said fuel filter to said fitting by said securing means, whereby said flange is held between said fuel filter and said junction region.

3. In a carburetor having a float chamber, a float assembly, a fuel inlet for directing fuel flow along a fuel path, a needle valve for cooperating with said float assembly, and means defining a needle valve seat within said fuel inlet for containing said needle valve, the improvement comprising:

a check valve member disposed within said fuel path upstream from said needle valve;

said fuel path being a closed path between said needle valve and said check valve member;

said valve member being costructed as a single piece from a resilient material and including a pair of lips arranged in a converging relationship to define for said valve member an open end and a normally closed end whereat said lips are disposed adjacent each other other to define a normally closed slit therebeween, and at least one side wall for connecting said lips, and an annular flange directed outwardly about the open end of said valve member;

said valve member being disposed with said closed end directed toward said needle valve;

means for clamping said flange for retaining said valve member within said fuel inlet;

said needle valve seat means including an inlet fitting mounted within said carburetor, said inlet fitting defining said seat for said needle valve;

said carburetor including a fuel line fitting connected to said inlet fitting for directing fuel along said fuel path to said fuel inlet;

said valve member being disposed within said inlet fitting and secured therein by connection to said inlet fitting of said fuel line fitting;

said inlet fitting including an outer end portion, the interior surface of said outer end portion including means for securing said fuel line fitting thereto, a relatively narrow central section, and a junction region between said outer end portion and said central section;

said valve member being disposed within said inlet fitting by placement of said lips and said side wall into said central section of said inlet fitting with said flange positioned adjacent said junction region; and said clamping means including said fuel line fitting and said junction region of said inlet fitting such that said valve member is secured by connection of said fuel line fitting to said inlet fitting by said securing mean, whereby said flange is held between said fuel line fitting and said junction region.

4. In a motor vehicle fuel system having a tank, a fuel pump including a pump inlet and a pump outlet, a carburetor including a fuel inlet, a first fuel line connecting said pump inlet and said tank, a second fuel line connecting said pump outlet and said carburetor fuel inlet, and a third fuel line connecting said pump outlet and said tank, a first check valve disposed within said third fuel line near said tank for preventing flow from said tank into said third fuel line, said carburetor further including a needle valve disposed within said fuel inlet, the improvement comprising:

a second check valve disposed within said carburetor fuel inlet for preventing vacuum in said second fuel line from reaching said needle valve;

said second check valve including a valve member which is constructed as a single piece from a resilient material; and said valve member included a pair of lips arranged in a converging relationship to define for said valve member an open end and a normally closed end whereat said lips are disposed adjacent each other to define a normally closed slit therebetween, at least one side wall for connecting said lips, and an annular flange directed outwardly about the open end of said valve member.

5. A motor vehicle fuel system as defined in claim 4, wherein:

said fuel inlet includes an inlet fitting mounted within said carburetor, said inlet fitting defining a seat for said needle valve;

said fuel system includes a fuel line fitting secured to said second fuel line and connected to said inlet fitting; and said second check valve is disposed within said inlet fitting and secured therein by connection to said inlet fitting of said fuel line fitting.

6. A motor vehicle fuel system as defined in claim 4, wherein:

said fuel inlet includes an inlet fitting mounted within said carburetor, said fitting defining a seat for said needle valve;

said fuel system includes a fuel filter disposed within said second fuel line and connected to said fitting; and said second check valve is disposed within said fitting and secured therein by connection to said fitting of said fuel filter.

7. A motor vehicle fuel system as defined in claim 6, wherein:

said second check valve includes a valve member which is constructed as a single piece from a resilient material; and said valve member includes a pair of lips arranged in a converging relationship to define for said valve member an open end and a normally closed end whereat said lips are disposed adjacent each other to define a normally closed slit therebetween, at least one side wall for connecting said lips, and an annular flange directed outwardly about the open end of said valve member.

* * * * *